United States Patent [19]

Billmeyer

[11] 3,998,455

[45] Dec. 21, 1976

[54] FREE STANDING PORTABLE AND KNOCKDOWN TENNIS NET SUPPORTING SYSTEM

[75] Inventor: Robert E. Billmeyer, Wilton, Conn.

[73] Assignee: National Associates (U.S.A.) Inc., Wilton, Conn.

[22] Filed: Feb. 18, 1975

[21] Appl. No.: 550,821

[52] U.S. Cl. ..... 273/29 BD

[51] Int. Cl.[2] ..... A63B 61/00

[58] Field of Search ..... 273/29 BB, 30, 29 BC, 273/29 BD, 29 BE, 29 BG; 242/100

[56] References Cited

UNITED STATES PATENTS

| | | | |
|---|---|---|---|
| 1,444,344 | 2/1923 | Gourley | 273/29 BD |
| 3,312,467 | 4/1967 | Dawson | 273/26 A |

FOREIGN PATENTS OR APPLICATIONS

| | | | |
|---|---|---|---|
| 319,004 | 10/1902 | France | 273/30 |

*Primary Examiner*—Richard C. Pinkham
*Assistant Examiner*—T. Brown

[57] ABSTRACT

A free standing portable and knockdown tennis net support system, made up essentially of tubular light metal components, readily assembled for use on any suitable playing surface, and quickly disassembled for compact packaging for transportation. The components of the system having a weight, configuration and relative disposition whereby in use, the normal tensioning of the tennis net acts to flex a base portion of the system towards the playing surface. The system is made up of a pair of spaced apart net anchor elements; each of the anchor elements being attached to opposite ends of an elongated, flexible stretcher base member. Each anchor element is provided with attachment members for supporting a tennis net in a substantially vertical plane, rather then away from such playing surface.

5 Claims, 9 Drawing Figures

FREE STANDING PORTABLE AND KNOCKDOWN TENNIS NET SUPPORTING SYSTEM

BACKGROUND OF THE INVENTION

With the ever increasing interest in tennis, and the vast increase in the number of devotees of the sport; the matter of providing large numbers of court facilities becomes more and more critical. Conventional tennis courts, both private and public are overwhelmed with players, despite some attempts to increase the number of available courts.

The obstacles to providing a sufficiency of the conventional tennis court are immediately apparent when one considers the scarcity of land suitable for such courts in accessible locations; the high price of the land, the cost of preparing the playing surface; and court maintenance costs.

As a partial answer to the problem of providing more tennis courts, it has been suggested that use be made of existing surfaces which may be used as reasonably acceptable tennis playing surfaces, such as parking lots of all kinds, playgrounds, city streets temporarily closed, driveways, aeroplane runways when not in use, and the like.

However, even which such playing surfaces, there must be provided tennis net supporting systems which permit the suitable tensioning of the tennis net as per regulations, as well as portability of the system. While some such systems have been suggested and offered for use and sale; they have been found to present a number of disadvantages, such that their use is extremely limited. Thus, such known systems invariably rely on substantial weights for the anchor portions of the systems in order to maximize the necessary tensioning of the supported net. The construction of such known systems, markedly limits the portability thereof and are of relatively high cost.

Accordingly, an object of this invention is to provide an improved tennis net support system of the portable and knockdown type; which is made up of a number of components which are readily and quickly assembled and disassembled; which is of light weight so as to facilitate transportation thereof; and is of relatively low cost to manufacture and distribute.

Another object of this invention is to provide a system of the character described, where the components are essentially derived from light metal or metal alloys in tubular form to reduce weight while maintaining optimum physical properties.

A further object of this invention is to provide a net supporting system of the character described which includes an elongated stretcher with net anchoring assemblies at the opposite ends thereof, together with footing members disposed at opposite ends of the stretcher and transversely thereof, the interrelation of such components being such that upon tensioning the tennis net while it is connected to the anchoring assemblies, the stretcher tends to move toward the playing surface rather than being lifted away therefrom.

Still another object of this invention is to provide a net supporting system of the character described, where the footing members may be adjustably positioned at desired spacings therebetween, to suit particular playing conditions.

Yet another object of this invention is to provide a net supporting system of the character described, wherein the several components of the system are off the shelf items, avoiding parts requiring special fabrication; thereby keeping manufacturing costs at a minimum.

Still a further object of this invention is to provide a net supporting system of the character described wherein assembly or disassembly may be accomplished simply and rapidly with the aid of a few common tools.

Other objects of this invention will in part be obvious and in part hereinafter pointed out.

DESCRIPTION OF THE PREFERRED EMBODIMENTS

Figure 1:
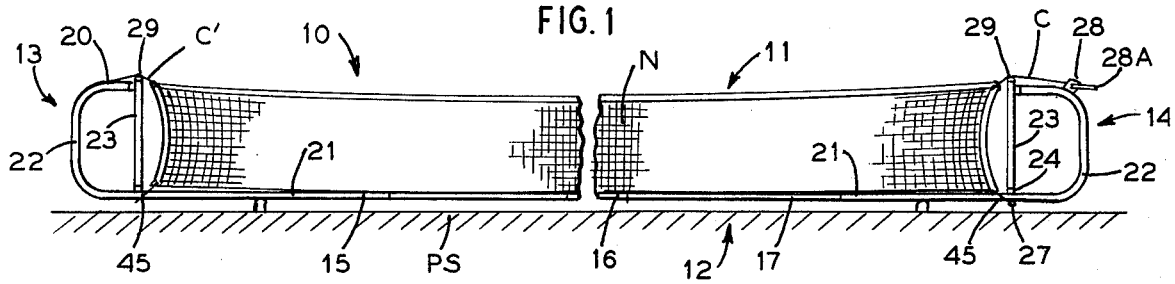
FIG. 1 is an elevational view showing the tennis net support system embodying the invention, in its assembled set-up form.
Figure 3:
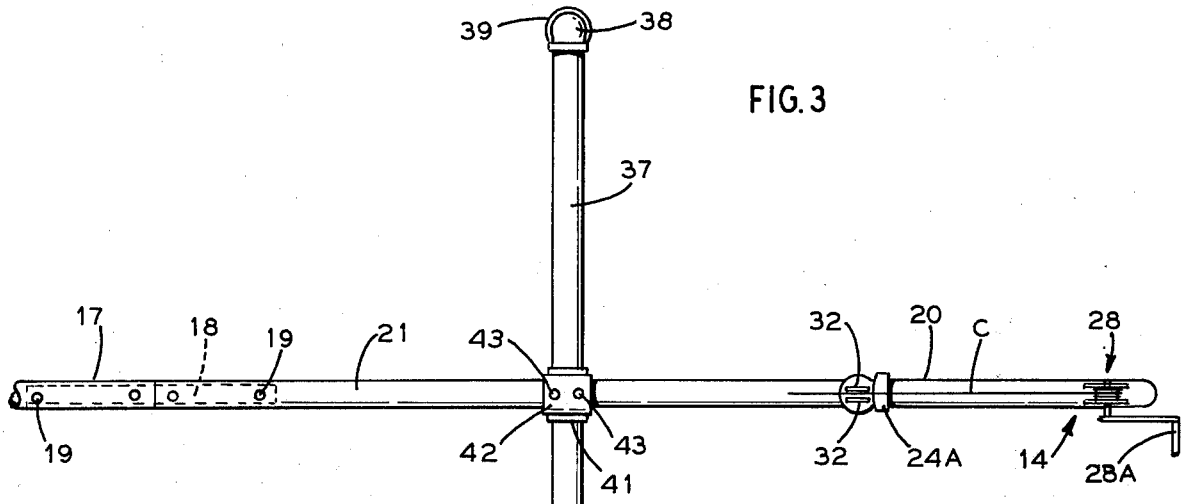
FIG. 3 is a top plan view thereof.
Figure 2:
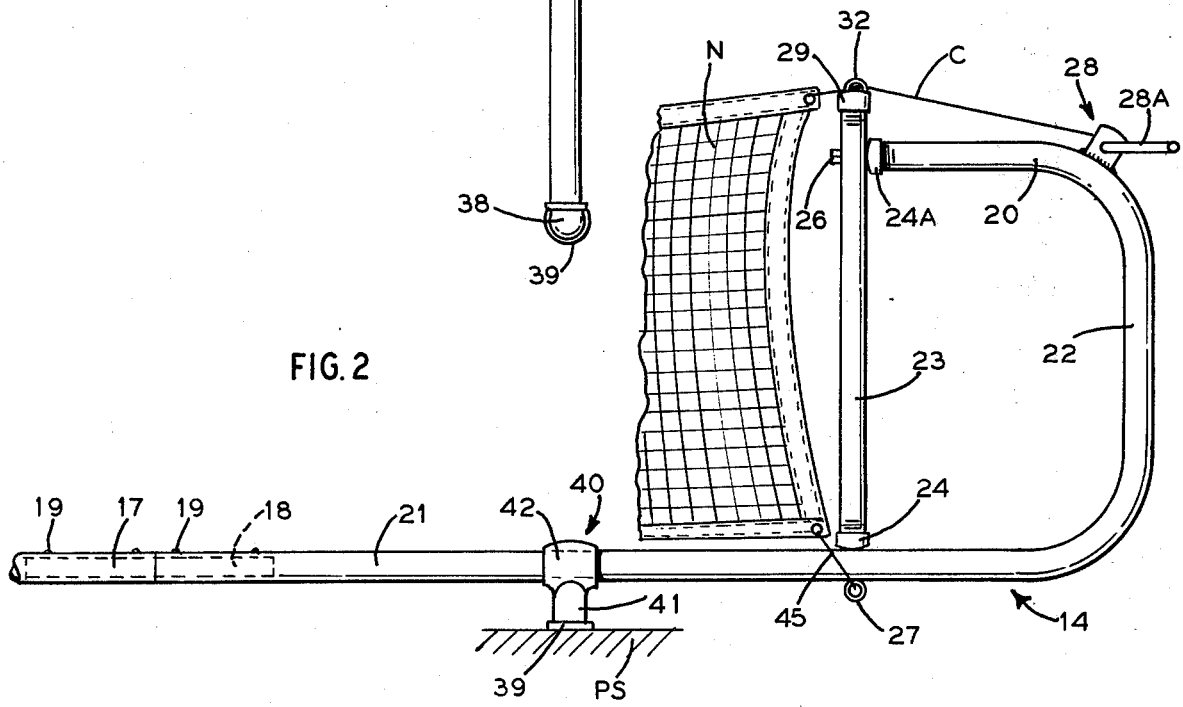
FIG. 2 is an elevational view showing one of the net anchoring assemblies.

Referring in detail to the drawings, and particularly FIG. 1, 10 designates generally a free standing tennis net supporting system embodying the invention and in its assembled condition disposed on a suitable playing surface PS.

System 10 comprises a net supporting assembly generally indicated at 11. Such assembly 11 comprises elongated stretcher means 12, which interconnects net anchoring means 13, 14 at the opposite ends thereof.

The stretcher means 12 is made up of a suitable number of tubular members of light weight metal, which can be 3 in number, indicated at 15, 16 and 17. Members 15, 16 and 17 are separably interconnected in end to end relation by splicing members 18 which are telescopically related to said members 15, 16 and 17. Set screws 19 located adjacent the joints fix members 15, 16 and 17 relative to each other.

The net anchoring means 13, 14 are similar except as hereinafter pointed out. Anchoring means 13 is removably connected to the outer end of stretcher member 15 while anchoring means 14 is removably connected to the outer end of stretcher member 17.

Net anchoring means 14 is formed from light metal tubing which is bent to provide a horizontal short arm portion 20; a horizontal long arm portion 21 and a vertical portion 22 connecting the outer ends of portions 20, 21. Anchoring means 14 further includes a vertical strut member 23 which is externally threaded at the opposite ends thereof.

An internally threaded cap 24 having a central threaded opening 25 in its top wall, is screwed on to the lower threaded portion of strut member 23. A similar cap 24A is screwed on a threaded end portion of short arm portion 20. The strut member 23 is connected in a vertical position, at its upper end to short arm 20 by way of a bolt 26 extending through aligned openings in strut member 23 and screwed into threaded opening 25 of cap 24A. An eyebolt 27 passing through aligned openings in a midportion of lower long arm portion 21, is threaded into the opening 25 of cap 24, thus securing strut member 23 in place.

Figure 5:
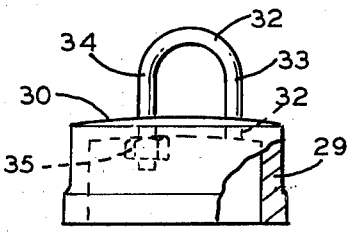
FIG. 5 is a side elevational view, with parts in section, showing a guide member component of the system.
Figure 6:
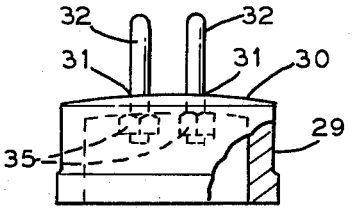
FIG. 6 is an end view thereof, with parts broken away and parts in section.
Figure 7:
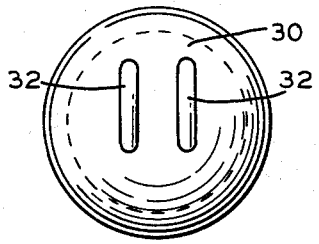
FIG. 7 is a top plan view thereof.
Figure 8:
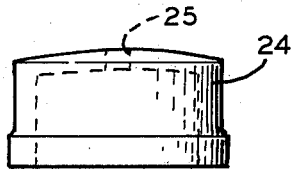
FIG. 8 is a side elevational view of a cap member component of the system.
Figure 9:
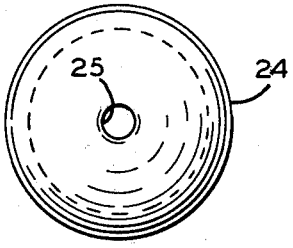
FIG. 9 is a top plan view thereof.

Means is provided for guiding one end portion of cable or rope C on tennis net N towards tensioning means 28 mounted on upper arm portion 20 of net anchoring means 14. To this end, such guiding means comprises an internally threaded cap 29 which is screwed on to the upper threaded portion of strut member 23, As shown in FIGS. 5–7, cap 29 has its top wall 30 formed with a pair of adjacent through openings 31 and a pair of U-shaped members 32. U shaped members 32 having short arms 33 and threaded long arms 34 are mounted on top wall 30, with the lower end of short arms 33 received in U-shaped members 32 in said top wall 30. Further, the long arms 34 pass through openings 31 with nuts 35 screwed on the lower ends of said arms 34, to lock members 32 in place and in spaced parallel relation to each other, for passing rope C therebetween.

The stretcher means 12 and interconnected net anchoring means 13, 14 are disposed in an upstanding position on playing surface PS by footing means at opposite end portions thereof and generally indicated at 36.

Each of footing means 36 comprises a tubular member 37 threaded at the opposite ends thereof to receive elbow members 38 with end flange portions 39 for contacting the playing surface PS. A T member 40 having short tubular portions 41, 42 at right angles to each other, provide means for adjustably connecting footing means 36 to net anchoring means 13, 14.

Figure 4:
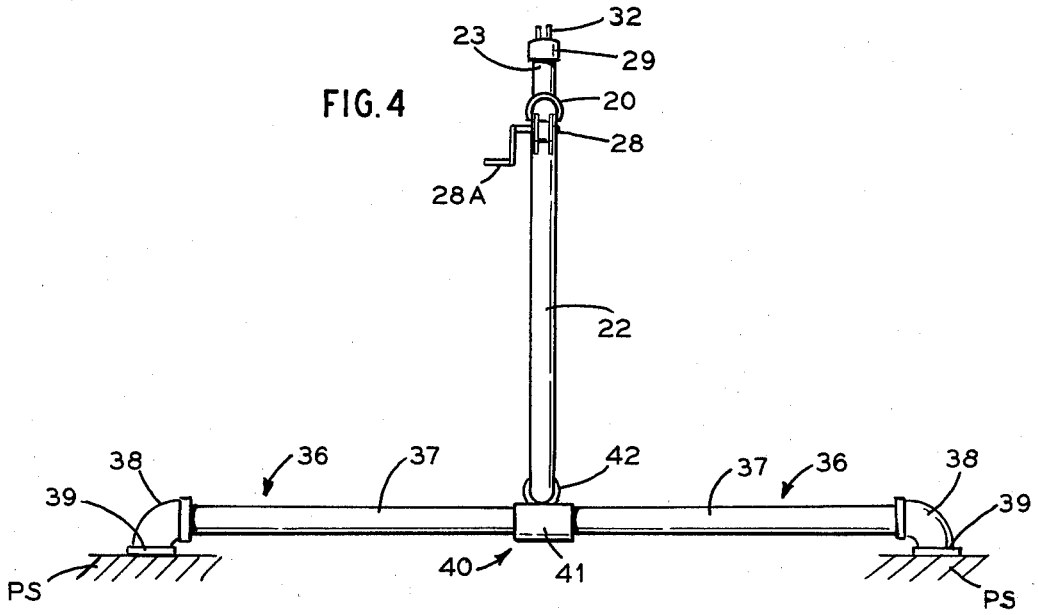
FIG. 4 is an end view thereof.

Thus, member 37 is mounted in lower portion 41, FIG. 4 and is locked in place by set screws, not shown. Long arm portion 21 of net anchoring means 13, 14 is mounted in the upper portion 42. The footing means 36 may be slidably positioned on arms 21 to selected distances therebetween and then locked in place by set screws 43.

Tensioning means 28 is a conventional ratchet type reel suitably affixed to short arm 20 of net anchoring means 14. The end of cable or rope C is wound on the shaft of reel 28 by way of operating handle 28A. Net anchoring means 13 is similar to net anchoring means 14 except that tensioning means 28 is omitted and cable end C′ passes through guide means similar to that shown on net anchor means 14 and then suitably secured by an eyebolt or the like, not shown.

The lower terminal portions 45 of the cable or rope at the lower corners of net N, are secured by way of eyebolts 27. Thus, net N is fully mounted on net anchoring means 13, 14. By operating handle 28A the proper amount of tension is imparted to net N.

It has been found that such tensioning of net N moves the upper portions of the net anchoring means 13, 14 toward each other with a resultant flexure of the stretcher means 12 toward the playing surface, the footing means 36 acting as a quasi fulcrum. Thus, despite the minimal weight of the net supporting system 10, the system as a whole is firmly anchored with respect to play surface PS.

The system 10 is quickly and easily assembled for use on a selected playing surface PS, with the aid of simple tools; and just as readily disassembled for packaging in compact form, thereby facilitating transportion thereof.

The several tubular assemblies and elements may be formed of light metals or metal alloys, such as aluminum or the like.

I claim:

1. A portable and knockdown tennis net support system for removably mounting on a conventional lawn tennis playing surface, said system comprising an elongated substantially horizontal stretcher base means, net anchoring means attached to opposite ends of said stretcher means and in upstanding relationship therewith each of said anchoring means including an elongated extension stretcher portion, means for connecting each of said extension stretcher portions to opposite ends of said stretcher means in axial alignment therewith; and footing means, said footing means comprising elongated footing members having portions thereon for contacting said playing surface, means for mounting a footing member intermediate the ends of each of said extension stretcher portions and in transverse relation thereto, means for securing upper and lower corner portions of a lawn tennis net at one end thereof to corresponding upper and lower portions of one of said net anchoring means, means for securing upper and lower corner portions of said net at the other end thereof to corresponding upper and lower portions of the other of said net anchoring means, and tensioning means on an upper portion of the other of said anchoring means for engaging the upper corner portion of said net at the other end thereof for tensioning said net as a whole; each of said net anchoring means comprising a tubular member bent into a substantially J-shaped configuration, the long leg of said J-shape being at a lower elevation than the short leg of said J-shape, said long leg being attached to one end of said stretcher means and being said extension, stretcher portion thereof, said short and long legs of said J-shape being coplanar in a substantially vertical plane; a vertical strut member, said strut member having its lower end attached intermediate the ends of said long leg, and said short leg having its free end attached adjacent the upper end of said vertical strut member, said tensioning means being mounted on said upper leg of one of said anchoring means.

2. A net supporting system as in claim 1 wherein said stretcher means comprises a plurality of tubular members and means for splicing said tubular members together in end to end relation.

3. A net support system as in claim 1 wherein said footing members are slidably mounted on each of said extension stretcher portions to locate said footing members at selected spacings thereon.

4. A net support system as in claim 1, wherein said means for securing said upper and lower corner portions of a lawn tennis net includes cable portions, and guide means on the upper end of said strut member for directing an adjacent cable portion towards said tensioning means.

5. For use in a portable and knockdown tennis net support system, net anchoring means and footing means connected to said anchoring means for holding said anchoring means in a substantially vertical plane, said net anchoring means comprising a member including a horizontally disposed short arm portion, a horizontally disposed long arm portion in parallel relation to said short arm portion and a vertical portion interconnecting said short and long arm portions at one end thereof, and a strut member interconnecting the free end of said short arm portion and an intermediate portion of said long arm portion, cable tensioning means on said short arm portion, said footing means comprising an elongated member having footing members on the opposite ends of said elongated member, and means coupling a mid portion of said elongated member to said long arm portion in transverse relation thereto.

* * * * *